US010208648B1

(12) United States Patent
Cooper

(10) Patent No.: US 10,208,648 B1
(45) Date of Patent: Feb. 19, 2019

(54) ENGINE OIL COOLER BACKFLUSH VALVE ASSEMBLY

(71) Applicant: James A. Cooper, Floyds Knobs, IN (US)

(72) Inventor: James A. Cooper, Floyds Knobs, IN (US)

( * ) Notice: Subject to any disclaimer, the term of this patent is extended or adjusted under 35 U.S.C. 154(b) by 0 days.

(21) Appl. No.: 15/436,233

(22) Filed: Feb. 17, 2017

Related U.S. Application Data

(60) Provisional application No. 62/389,127, filed on Feb. 17, 2016.

(51) Int. Cl.

| | |
|---|---|
| ***F01P 11/06*** | (2006.01) |
| ***F02M 26/30*** | (2016.01) |
| ***F01M 5/00*** | (2006.01) |
| ***F01P 3/20*** | (2006.01) |
| ***F01P 7/14*** | (2006.01) |

(52) U.S. Cl.
CPC ..... *F01P 11/06* (2013.01); *F01M 5/002* (2013.01); *F01P 3/20* (2013.01); *F01P 7/14* (2013.01); *F02M 26/30* (2016.02); *F01P 2007/146* (2013.01); *F01P 2011/065* (2013.01); *F01P 2060/04* (2013.01)

(58) Field of Classification Search
CPC ..... F01P 11/06; F01P 3/20; F01P 7/14; F01P 2007/146; F01P 2011/065; F01P 2060/04; F02M 26/30; F01M 5/002
USPC ..... 123/41.08
See application file for complete search history.

(56) References Cited

U.S. PATENT DOCUMENTS

| | | | | |
|---|---|---|---|---|
| 2,839,068 A * | 6/1958 | Cassia | F01P 11/0214 134/102.1 |
| 4,519,449 A * | 5/1985 | Hoskins | F28F 9/0234 165/141 |
| 9,587,532 B1 * | 3/2017 | Au | F01M 11/03 |

OTHER PUBLICATIONS bulletproofdiesel.com: What's Wrong with the 6.0L Oil Cooler? Dec. 27, 2015, http://www.bulletproofdiesel.com/Articles.asp?ID=155, Web.

www.powerstroke.org , www.ford-trucks.com, www.thedieselstop.com: Ford Powerstroke 6.0L Turbo Diesel Cooling System Overview and Flush, Version 1.2, Jun. 22, 2011.

dieseliq.com: The Biggest Problems With Power Stroke 6.0 Liter Diesel Engines, Dec. 20, 2016, retrieved from Internet Wayback Machine at https://web.archive.org/web/20161220041840/https://dieseliq.com/problems-with-power-stroke-60, Web.

Gaskell, Rob, et al.: The 6.0L Powerstroke Diesel, Nov. 16, 2016, retrieved from Internet Wayback Machine at https://web.archive.org/web/20161116231120/http://www.fleetservicenorthwest.com/Pages/6LPSD062209.aspx, Web.

(Continued)

*Primary Examiner* — Syed O Hasan
(74) *Attorney, Agent, or Firm* — Middleton Reutlinger; Robert H. Eichenberger

(57) ABSTRACT

An engine oil cooler backflush valve assembly is provided as a replacement cap to an engine oil cooler EGR coolant supply cover. The backflush valve assembly includes a main body through which a valve stem is inserted. The valve stem has a bushing threadedly attached thereto which moves the valve stem between first and second positions. A removable cap is provided to cover the backflush valve assembly during normal operation and to be removed during backflush operation. A removable lock can also be used to secure the cap and/or bushing to the main body of the assembly.

22 Claims, 10 Drawing Sheets

(56) References Cited

OTHER PUBLICATIONS

Ford: Ford Power Stroke Diesel, Diesel Sales Reference Manual, selected pages from Manual, Jan. 1, 2015.
www.powerstroke.org: Ford Powerstroke Diesel Forum, Replaced Oil Cooler Still Difference in temps—p. 64, Aug. 22, 2016, retrieved from Internet Wayback Machine at https://web.archive.org/web/20160822095304/http://www.powerstroke.org/forum/6-0-motor-problems/149749-replaced-oil-cooler-still-difference-temps-64.html, Web.
www.ford-trucks.com: Ford Truck Enthusiasts Forums, Oil Cooler Backflush Question, Nov. 4, 2015, retrieved from Internet Wayback Machine at https://web.archive.org/web/20151104192451/https://www.ford-trucks.com/forums/1158329-oil-cooler-backflush-question.html, Web.
www.littlepowershop.com: Are the Ford 6.0 Powerstroke Diesels Just Junk With Too Many Problems?, Mar. 6, 2015, retrieved from Internet Wayback Machine at https://web.archive.org/web/20150306203516/https://www.littlepowershop.com/blogging/are-the-ford-60-powerstroke-diesels-just-junk-with-too-many-problems/, Web.
www.youtube.com: 6.0L Oil Cooler Backflush, Jul. 15, 2015, https://www.youtube.com/watch?v=832rxNbRTQA, Web.
www.youtube.com: 6.0L EGR Cooler Delete and Oil Cooler Issues, Oct. 12, 2011, https://www.youtube.com/watch?v=jcaV74zTJh0, Web.
www.youtube.com: 6.0 System Flush, Dec. 4, 2010, https://www.youtube.com/watch?v=tpYCfqcNEh4, Web.
www.powerstroke.org, 6.0L Powerstroke Oil Cooler Back-Flush Procedure, Aug. 28, 2015, retrieved from Internet Wayback Machine at https://web.archive.org/web/20150828235152/http://powerstrokehelp.com/6liter/6.0l_back_flush_procedure.asp, Web.
dan.prxy.org: 2003 6.0L Bible Table of Contents, Component Locations, published Dec. 8, 2016, retrieved from Internet Wayback Machine at https://web.archive.org/web/20161208002124/http://dan.prxy.org/Truck/6L_bible_html/html/TOC.html, retrieved from internet Feb. 6, 2018, Web.
dan.prxy.org: 2003 6.0L Bible Table of Contents, Cooling System, Dec. 8, 2016, retrieved from Internet Wayback Machine at https://web.archive.org/web/20161208002124/http://dan.prxy.org/Truck/6L_bible_html/html/TOC.html, retrieved from internet Feb. 6, 2018, Web.
dan.prxy.org: 2003 6.0L Bible Table of Contents, Lubrication System, Dec. 8, 2016, retrieved from Internet Wayback Machine at https://web.archive.org/web/20161208002124/http://dan.prxy.org/Truck/6L_bible_html/html/TOC.html, retrieved from internet Feb. 6, 2018, Web.

* cited by examiner

ENGINE OIL COOLER BACKFLUSH VALVE ASSEMBLY

BACKGROUND

Diesel engines are one form of internal combustion engines, which convert chemical energy from a fossil fuel into heat energy (of combustion) into mechanical energy to produce work. In gasoline internal combustion engines, a first stroke occurs when a fuel-air mixture is allowed into the engine's cylinders via intake valves that are allowed to open via a camshaft. In a second stroke, a piston compresses a fuel-air mixture in the cylinder, creating very high temperatures and pressure. In gasoline engines, the compressed mixture is ignited by a spark from a spark plug, and the explosion generates power to push the piston in the opposite direction along the cylinder (in a third stroke). Finally, in a fourth stroke, exhaust gases are pushed out through an exhaust valve, and the process is repeated many times per second.

In a diesel engine, air is drawn into the cylinder and the inlet valve closes while the piston moves to compress the air mixture. This air is compressed to a much higher pressure than a fuel-air mixture in a gasoline engine. This greater compression of the gas generates a greater amount of heat, and diesel fuel is then injected into the very hot cylinder and the mixture spontaneously ignites without the need for an electric spark. The controlled explosion forces the piston in the opposite direction, which sends power to the wheels via a connecting rod and crankshaft and other components. To complete the cycle, gas is exhausted out the outlet valve, and the cycle repeats itself many times per second.

As a result of the excessively high temperature and pressure involved, controlling temperatures within a diesel engine is important, and various cooling systems are commonly known which attempt to do so. A typical engine cooling system uses liquid coolant (e.g., antifreeze) to cool various engine components (e.g., the cylinder head, the engine block, etc.). To achieve this, coolant is pumped around various portions of the engine compartment through hoses, and the coolant picks up heat from the engine, lubricates the water pump, and transfers the heat to a radiator, where the heat is dissipated and the coolant cooled to repeat the process. Typically, coolant is pumped via a water pump and flows from a lower radiator tank to the engine block, then to the cylinder head, and finally past a thermostat and into the upper radiator hose into the radiator. As the coolant flows down inside the radiator, the coolant loses its heat to the cooler air that is flowing past the space between the flat tubes of the radiator. By the time the coolant has reached the lower radiator tank, it has lost a considerable amount of heat and is therefore able to repeat the process as it recirculates back to the engine through its flow path.

While engine cooling systems keep temperatures of various engine components within desired temperature ranges, engine oil coolers are also known for certain engines, including diesel engines, and these coolers use the engine's cooling system to reduce the temperature of the engine oil. An engine oil cooler is a component having an oil inlet and an oil outlet wherein the oil is passed (via an oil pump) around a cooling device, typically a fluid-to-fluid heat exchanger. The two fluids involved are coolant (antifreeze) flowing within heat exchanger passages and engine oil in which the heat exchanger is immersed or in surface contact. The engine oil cooler transfers heat from the entering hot oil to the coolant via the heat exchanger contact so that the oil exiting the cooler is at an acceptable temperature to be circulated along its path for use as lubrication for the many engine components that are lubricated by the engine oil. Maintaining oil at proper operating temperatures is important for several reasons, but one reason is that the viscosity of oil is reduced as the oil temperature rises. As the oil viscosity reduces, its ability to lubricate the moving engine components is reduced. If lubrication is reduced, friction, wear, heat, and ultimately component failures can occur.

Because regulating engine oil temperature in diesel engines is important to proper functioning and long-life of the engine, it is important to ensure that the engine oil cooler is functioning properly. In some engines, most notably the 6.0 Liter diesel engines sold under the trademark Powerstroke® used in the 2003-2007 Ford® Super Duty® trucks, various types of problems are known. These particular engines are highly sensitive to engine coolant and engine oil supply and temperature problems, and some of these problems can be discovered by an increasing difference in the coolant temperature from that of the oil temperature. For a variety of reasons in these engines, the coolant side of the heat exchanger in the oil cooler has a tendency to become restricted with debris which circulates with the coolant. The small passages in the oil cooler then become restricted, which reduces the amount of coolant available to cool the engine oil. Over time, this debris significantly impedes coolant flow within the oil cooler, which eventually significantly impedes coolant from exiting the oil cooler and entering into the Exhaust Gas Recirculator (EGR) cooler downstream. The EGR is an air-to-liquid heat exchanger that uses the engine coolant to reduce exhaust gas temperatures prior to recirculating the gases through the engine's intake system. This leads to higher oil temperatures as the oil unsuccessfully attempts to properly cool and lubricate the engine systems and components (main bearings and lifters, turbocharger, high pressure oil pump, fuel injectors, etc.). Thus, a clogged or restricted oil cooler can lead to extremely expensive repairs.

The typical repair/solution for restricted/plugged oil cooler is to replace the engine oil cooler. This is a time-consuming and expensive repair. Worse is the fact that often the new oil coolers become restricted shortly after they are installed due to debris remaining in the coolant system. Both the stock oil coolers and the replacement oil coolers are closed systems having a top cover (i.e., an EGR coolant supply cover), yet have no mechanism to allow cleaning and, indeed, no reference to cleaning in the manufacturer's literature. What is needed is a solution that allows a user to reduce buildup of dirt and debris within an engine oil cooler without the need for replacing the oil cooler, and also (in situations where the existing oil cooler is itself not replaced) without the need for removing and subsequently replacing the EGR coolant supply cover every time a backflush is performed. What is needed is an apparatus and method for a backflush valve assembly that, once installed, remains installed and provides a user with the ability to backflush the engine oil cooler without ever needing to remove and replace the EGR coolant supply cover in the future.

SUMMARY

The herein-described embodiments address these and other problems associated with the art by providing a backflush valve assembly capable of serving as a replacement, permanent oil cooler EGR coolant supply cover, while simultaneously serving as the backflush fitting. In some implementations, the assembly includes an oil cooler EGR coolant supply cover having a main body and a manually activated valve that can be selectively moved between a normal mode and a backflush mode. The engine oil cooler backflush valve assembly also includes, if desired, a drilled and tapped port for the installation of instrumentation to monitor the coolant operating pressure and/or temperature.

Embodiments of the apparatus provide engine owners or mechanics a means of easily and repetitively back flushing the coolant side of the oil cooler to ultimately dislodge and remove the material which was restricting the normal coolant flow without having to remove and replace the EGR coolant supply cover. These embodiments also can allow the flow of the coolant through the oil cooler to be checked by monitoring the coolant discharge temperature. If the discharge temperature has increased from an established baseline it indicates a reduction in coolant flow, and a need to backflush the oil cooler.

Some embodiments described herein incorporate a replacement EGR coolant supply cover that has approximately 30% greater volume than the standard factory-supplied cover. This greater volume reduces the pressure required to generate flow, thus increasing the coolant flow rate through the cooler which improves the engine oil cooler effectiveness.

Embodiments described allow the oil cooler to be back flushed while the engine is hot (and the oil cooler chambers fully opened/expanded), which assists in the removal of the debris plugging the oil cooler. These allow for the collection and measurement of the engine coolant discharging from the oil cooler, which can be used to aid in cooling system diagnosis and to determine the degree of blockage of the oil cooler. In other embodiments, the apparatus can optionally provide a direct point to add cleaners to the oil cooler to aid in the back flushing process.

In some implementations, the assembly has two operational positions, fully open (normal) and fully closed (backflush). When placed in the fully open position with the locking cap installed, the apparatus allows coolant flow in the normal direction in a first (normal) flow path through the engine oil cooler. When placed in the fully closed position with the locking cap removed and the radiator opened and a garden hose attached to the valve body, water can flow in the reverse direction through the engine oil cooler via a second (backflush) flow path and out through the open radiator. This reverse flow allows the oil cooler to be internally cleaned (backflushed). The locking cap, valve body, and housing can optionally be tied together in the open position using the holes and eyelets provided to prevent any unintended movement of the cap and/or valve.

In some embodiments, a backflush valve assembly for an engine oil cooler having an EGR coolant supply port is provided having a main body with a top surface, a bottom surface, and a perimeter depending from the top surface and defining a downwardly facing cavity, wherein the top surface has a fluid inlet therethrough and the perimeter has at least two mounting locations therearound and a perimeter recess therein and a gasket fitted within said perimeter recess. A valve is provided in the fluid inlet and has a valve stem with a first end and a second end, the first end having a valve seat thereon and the second end terminating in an open hollow cylinder. A bushing is connected to the valve stem and further comprises a first end and a second end. The said second end further comprises an open cylinder with external bushing threads and internal bushing threads, and the internal bushing threads extend throughout the entirety of the bushing. A cap is also provided which has an open cap first end with internal cap threads therein and a closed second end comprising a cap surface. The valve stem is movable from a first position to a second position, wherein in the first position the valve stem is not seated on the EGR coolant supply port, and wherein in the second position the valve stem is seated on the EGR coolant supply port.

In another embodiment a backflush valve assembly is provide having a housing having at least one mounting location for mounting to an engine oil cooler housing, wherein the engine oil cooler housing further comprises an EGR coolant supply port for directing coolant from the engine oil cooler to an engine oil cooler exit, the housing further comprising a cavity having a volume therein and defining a first flow path therein, wherein fluid can flow from the EGR coolant supply port through said first flow path to said engine oil cooler exit. A valve within the housing in included and is movable between an open (normal) position and a closed position, wherein in the open position the valve is not in contact with the EGR coolant supply port and in the closed (backflush) position the valve is in contact with the EGR coolant supply port, and wherein the valve has a fluid channel therethrough that is not in fluid communication with said first flow path when the valve is in the closed position. A removable cap is coupled to the valve, wherein the removable cap closes off the first flow path when the valve is in the first position.

A method of backflushing an engine oil cooler is provided which includes the steps of turning off the engine and providing a backflush valve assembly for permanently mounting to an engine oil cooler around an EGR coolant supply port thereof. The backflush valve assembly further comprises a main body and a fluid inlet therethrough and the main body has at least two mounting locations thereon. A valve is located in the fluid inlet and includes a valve stem having a first end and a second end. The first end has a valve seat thereon and the second end terminates in an open hollow cylinder. A bushing is connected to the valve stem and further comprises a first end and a second end, wherein the second end further comprises an open cylinder with external bushing threads and internal bushing threads and wherein the internal bushing threads extend throughout the entirety of the bushing. A cap has an open cap first end with internal cap threads therein and a closed second end comprising a cap surface, wherein the valve stem is movable from a first position to a second position. In the first position the valve stem is not seated on said EGR coolant supply port, and in the second position the valve stem is seated on said EGR coolant supply port. The method includes the step of mounting the backflush valve assembly to the engine cooler housing so as to cover the EGR coolant supply port. Once the backflush valve assembly is mounted, a user can move the valve from the first position to the second position, remove the cap, connect the bushing to a source of pressurized water, disconnect a lower radiator hose from the engine, and supply pressurized water to the backflush valve assembly. The user then continues to supply water to the backflush valve assembly until a desired amount of particulate matter has been removed. After this, the user can disconnect the supply of water from the bushing, move the valve from the second position to the first position, and replace the cap.

A method of facilitating repeatable backflushes of an engine oil cooler without the need to remove an EGR coolant supply cover for each backflush is also possible with embodiments of the invention. A method can include the steps of turning off the engine; removing the stock EGR coolant supply cover; and providing a backflush valve assembly for permanently mounting to an engine oil cooler around an EGR coolant supply port thereof. The backflush valve assembly further comprises a main body and a fluid inlet therethrough and the main body has at least two mounting locations thereon. A valve is included in the fluid inlet and includes a valve stem having a first end and a second end. The first end has a valve seat thereon and the second end terminates in an open hollow cylinder. A bushing is connected to the valve stem and further comprises a first end and a second end, wherein the second end further comprises an open cylinder with external bushing threads and internal bushing threads and wherein the internal bushing threads extend throughout the entirety of the bushing. A cap is included having an open cap first end with internal cap threads therein and a closed second end comprising a cap surface. The valve stem is movable from a first position to a second position, wherein in the first position the valve stem is not seated on the EGR coolant supply port and wherein in the second position the valve stem is seated on the EGR coolant supply port. The method includes mounting the backflush valve assembly to the engine cooler so as to cover the EGR coolant supply port.

These and other advantages and features, which characterize the invention, are set forth in the claims annexed hereto and form a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

The embodiments discussed hereinafter will focus on the implementation of the hereinafter-described apparatus and techniques within a particular 6.0 Liter diesel engine. However, it will be appreciated that the apparatus and techniques may also be used in connection with other types of engine oil coolers in some embodiments. For example, the herein-described techniques may be used in diesel engines made by other manufacturers for use in other brands of truck, as well as diesel engines made for vehicles other than trucks. Moreover, the apparatus can be useful in any form of engine having a liquid-to-liquid oil cooler.

Figure 1:
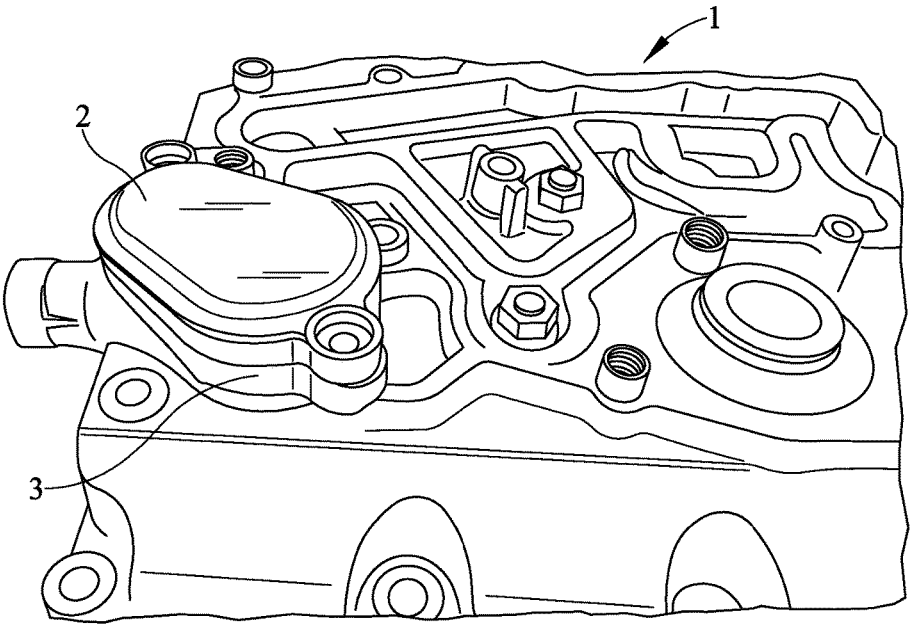
FIG. 1 is a perspective view of a stock engine oil cooler housing and a stock EGR coolant supply cover.
Figure 2:
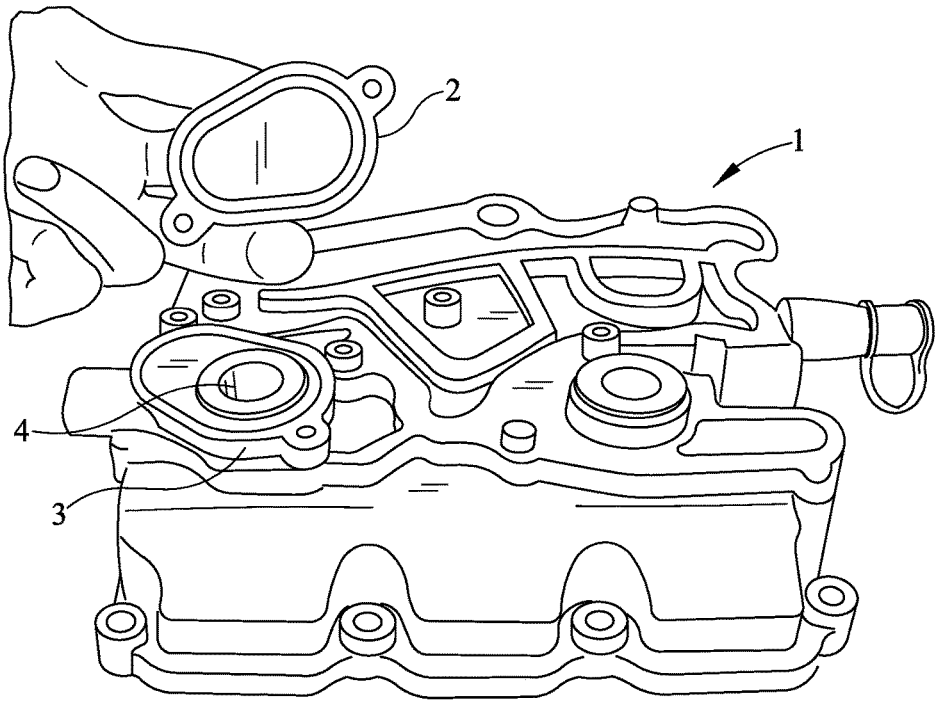
FIG. 2 is a perspective view of the engine oil cooler of FIG. 1 having the EGR coolant supply cover removed.
Figure 3:
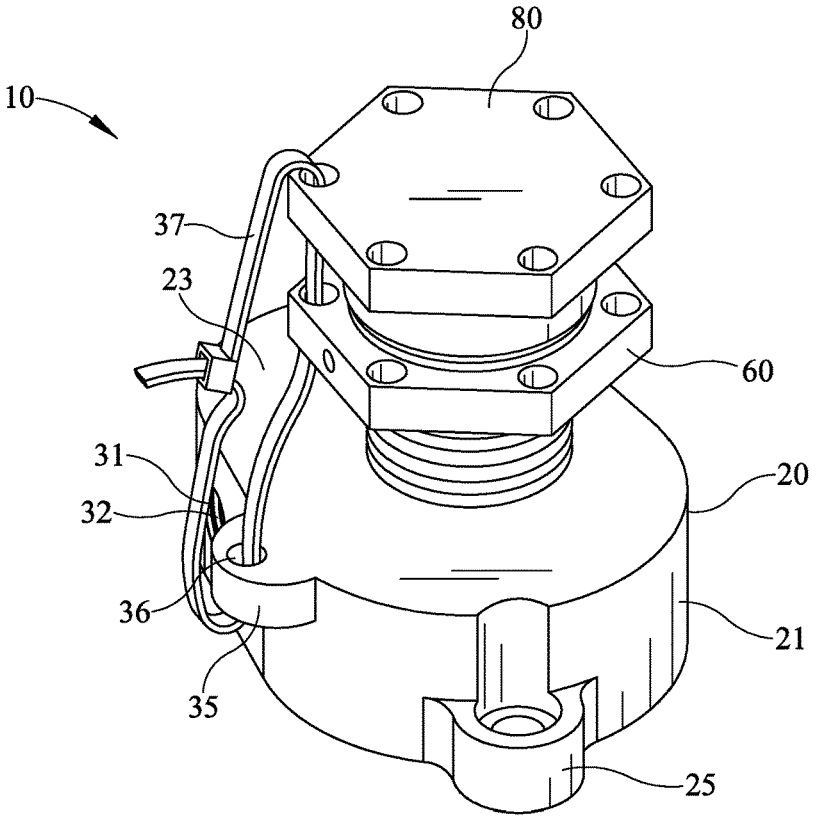
FIG. 3 is a perspective view of a backflush valve assembly according to an embodiment of the invention.

Turning now to the drawings, wherein like numbers denote like parts throughout the several views, FIG. 1 illustrates a standard 6.0 Liter diesel engine oil cooler housing 1 having a standard (stock) EGR coolant supply cover 2 covering an engine oil cooler outlet housing 3. FIG. 2 shows the same engine oil cooler housing 1 with the EGR coolant supply cover 2 removed, exposing the engine oil cooler outlet housing 3 and the EGR coolant supply port 4. These two figures clearly depict the stock EGR coolant supply cover 2 being a closed cap with no ports or openings in its top for fluid to flow.

FIGS. 3-9 illustrate a backflush valve assembly 10 according to an embodiment of the invention. The backflush valve assembly 10 includes a main body 20, a valve 40, a bushing 60, and a cap 80. The main body 20 is preferably sized and shaped to replace the stock or other EGR coolant supply cover 2 of an engine oil cooler housing 1, and fits atop an oil cooler outlet housing 3. The main body 20 has a perimeter surface 21 adapted to be received by an EGR coolant supply port 4. The main body 20 has a top surface 23, a bottom surface 24, and mounting locations 25. Fitted around the bottom of the perimeter surface 21 is a recess 26 to receive a gasket 27 (e.g., an EGR cover seal) (see FIG. 9).

Figure 4:
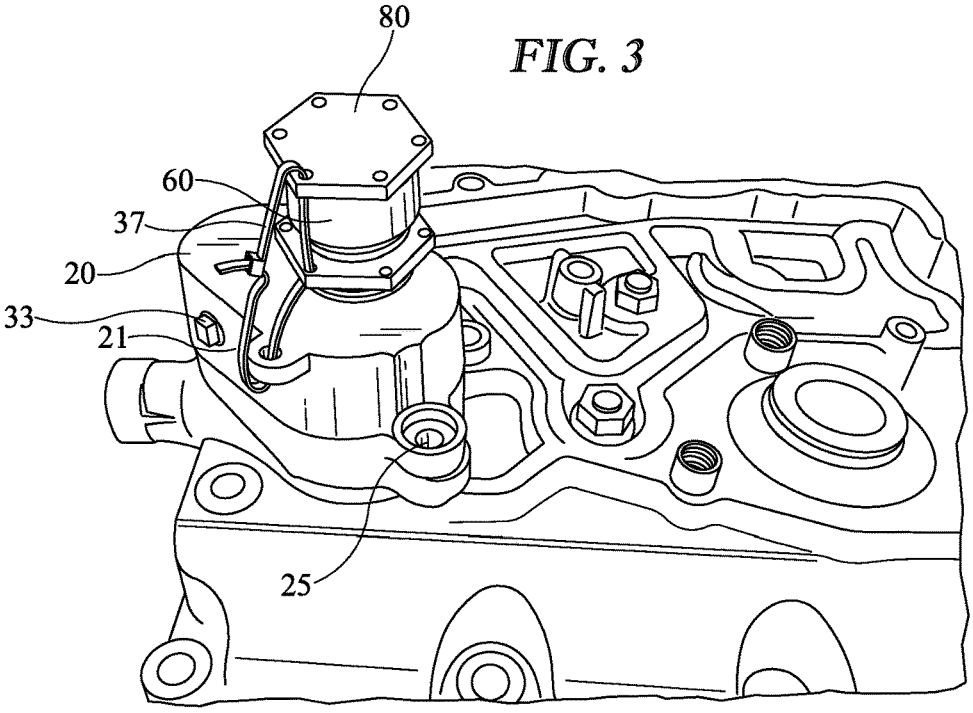
FIG. 4 is a perspective view of the backflush valve assembly of FIG. 3 installed on a stock engine oil cooler housing.
Figure 5:
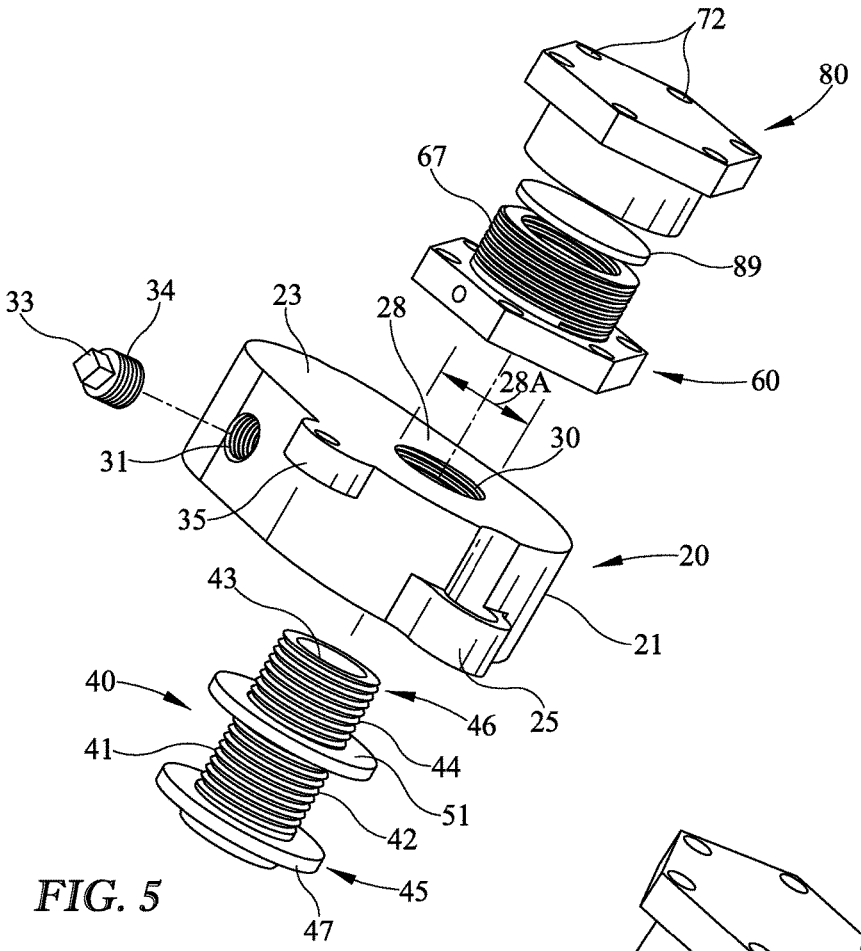
FIG. 5 is an exploded perspective view of the backflush valve assembly of FIG. 3.
Figure 9:
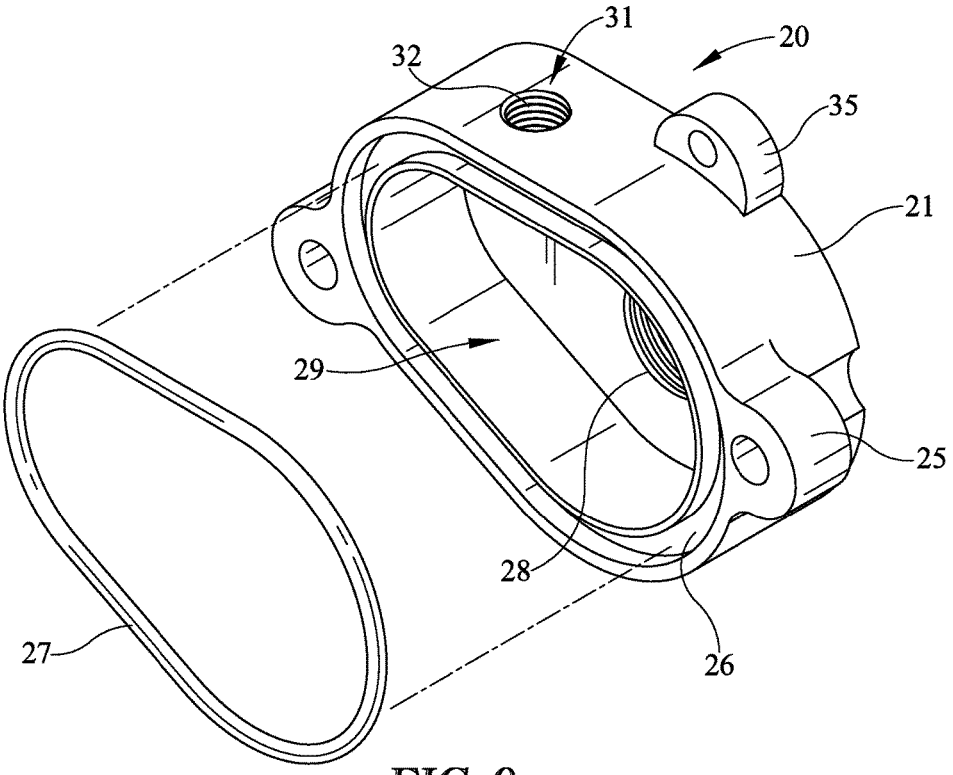
FIG. 9 is a bottom perspective view of the main body of FIG. 3 showing its internal cavity and valve stem opening threads.

Referring now to FIGS. 5 and 9, the main body 20 also has a valve stem opening 28 through the top surface 23 into cavity 29. Ideally, though not necessarily, cavity 29 can have a volume that is larger than the volume inside a stock EGR coolant supply cover, preferably in the range of 20% to 50% larger, and most preferably about 30% larger. Valve stem opening 28 has a diameter 28A and is preferably threaded with valve stem opening threads 30. The center line of the valve stem opening 28 is located to coincide with the center line of the EGR coolant supply port 4 of the engine oil cooler housing 1. FIG. 4 depicts the backflush valve assembly 10 mounted on the engine oil cooler housing 1.

With reference to FIGS. 5-8, the perimeter surface 21 also has a diagnostic port 31, with internal threads 32. With additional reference to FIG. 4, the diagnostic port 31 also preferably has a plug 33 with plug threads 34 mateable with internal threads 32. Plug 33 is removable from the diagnostic port 31 by disengaging plug threads 34 from internal threads 32. Optionally the main body 20 can also have one or more tabs 35 with openings 36 for securing various components to prevent movement or loss, as will be described below.

Figure 10:
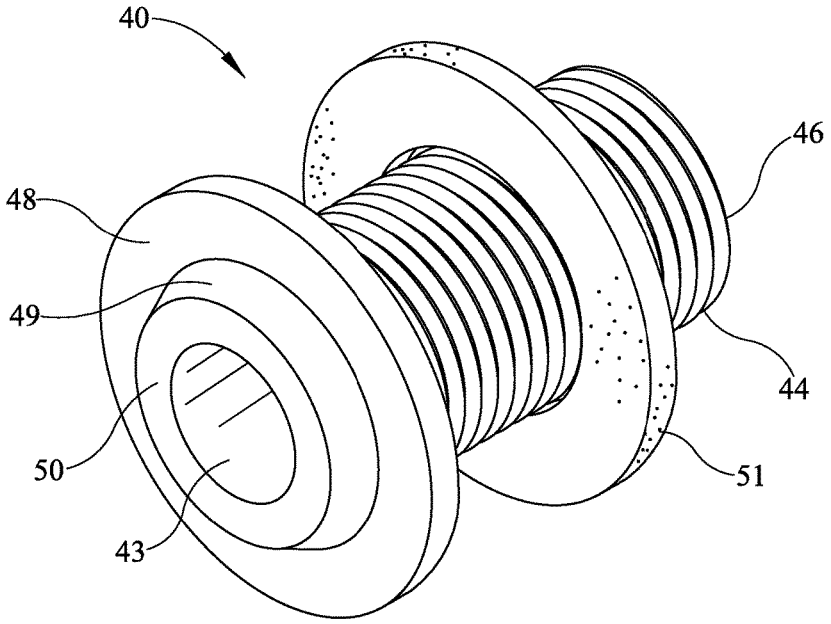
FIG. 10 is a perspective view of the valve stem and gasket according to an embodiment.

With continued reference to FIGS. 5-8, and additional reference to FIG. 10, valve 40 comprises a hollow cylindrical valve stem 41 having an external surface 42 and an internal surface 43. The external surface 42 comprises valve stem threads 44. With particular reference to FIG. 10, valve stem 41 also has a first end 45 and a second end 46. First end 45 comprises a valve seat 47 having a valve seat flange 48 and a ramped surface 49 terminating in a bottom annular surface 50. The valve stem threads 44 are threadedly engageable within the valve stem opening threads 30 in the main body 20. A gasket 51 is also present and fits over the valve stem threads 44. The gasket 51 serves to seal the cavity 29 when the valve 40 is in the open position. The gasket 51 can be of any of a variety of materials commonly used as gaskets and/or seals, such as certain types of elastomers or rubbers, preferably of a material that is compatible with, or at least not reactive with or damaged by common varieties of diesel engine coolants. In the preferred embodiment the gasket 51 is an ethylene propylene diene monomer (EPDM) washer.

Figure 11:
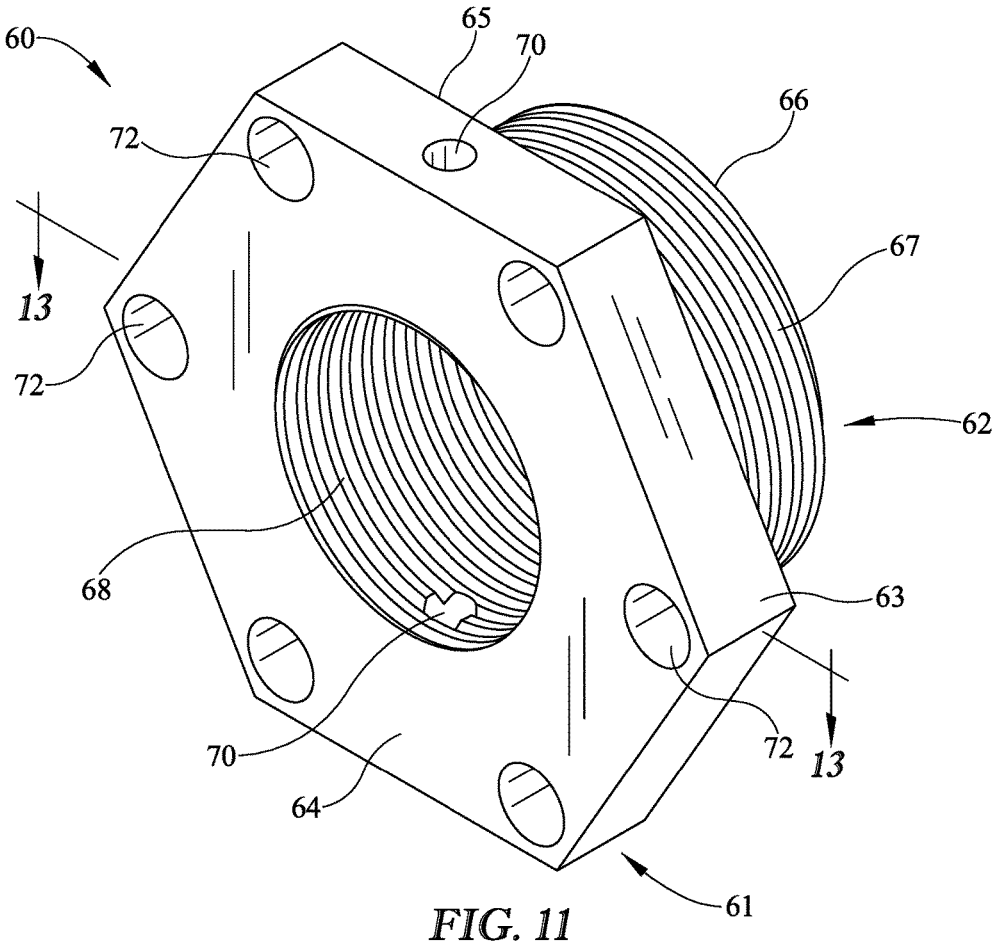
FIG. 11 is a perspective view of the bushing according to an embodiment.
Figure 12:
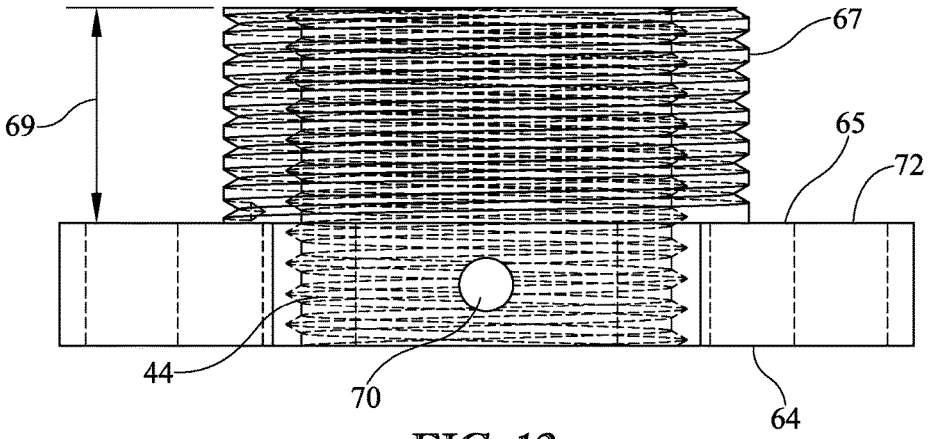
FIG. 12 is a side view of the bushing of FIG. 11 showing some hidden lines.
Figure 13:
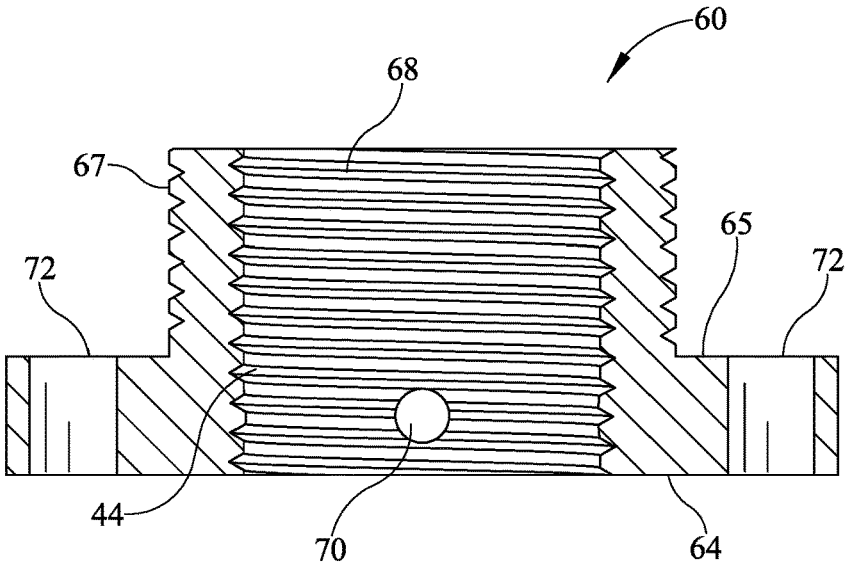
FIG. 13 is a section view of the bushing of FIG. 11 taken along line 13-13.

Referring now to FIGS. 11-13, the bushing 60 is shown. Bushing 60 has a first end 61 and a second end 62. First end 61 preferably has an external hexagonal perimeter 63 with a lower surface 64 and an upper surface 65. Second end 62 comprises an open cylinder 66 having external bushing threads 67 and internal bushing threads 68. Bushing 60 has a bushing length 69 that is a distance from upper surface 65 to second end 62 (see FIG. 12). Internal bushing threads 68 threadedly receive valve stem threads 44. With particular reference to FIGS. 11-13 and FIG. 17, in a preferred embodiment external hexagonal perimeter 63 further comprises a drive pin opening 70 to receive a drive pin 71, as will be described below. Bushing 60 can optionally have one or more openings 72 in the external hexagonal perimeter 63 through the upper surface 65 and lower surface 64. Optionally the main body 20 can also have one or more tabs 35 with openings 36 for securing various components to prevent movement or loss. With reference back to FIG. 3, one or more locks 37 can be used to secure the bushing 60 to the body 20 via the openings 36 and openings 72. The lock 37 can be of a variety of forms, including zip ties, cables, wire, and the like that can be inserted through openings 36 and openings 72 and tightened. Once tightened, the lock 37 prevents or inhibits relative movement between the bushing 60 and the main body 20. It is noted that often the openings 72 and openings 36 will not be vertically aligned perfectly, so the one or more locks 37 are preferably flexible in some fashion to be able to be inserted through each set of openings 36, 72. However, other forms of locks 37, even those that are not flexible, can be used in similar fashion.

Figure 14:
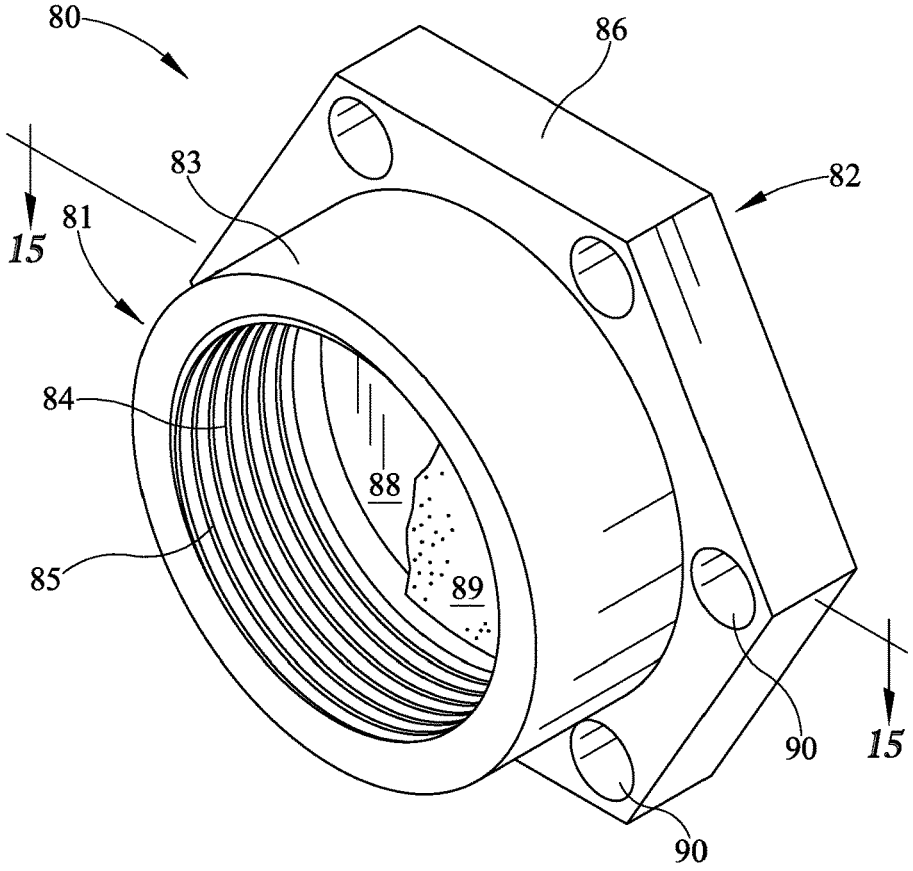
FIG. 14 is a perspective view of the cap according to an embodiment.
Figure 15:
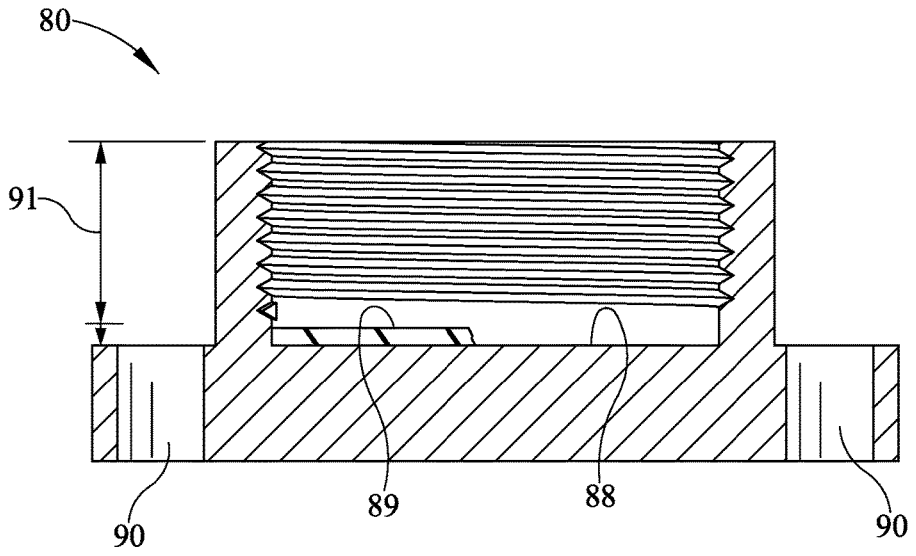
FIG. 15 is a section view of the cap of FIG. 14 taken along line 15-15.
Figure 16:
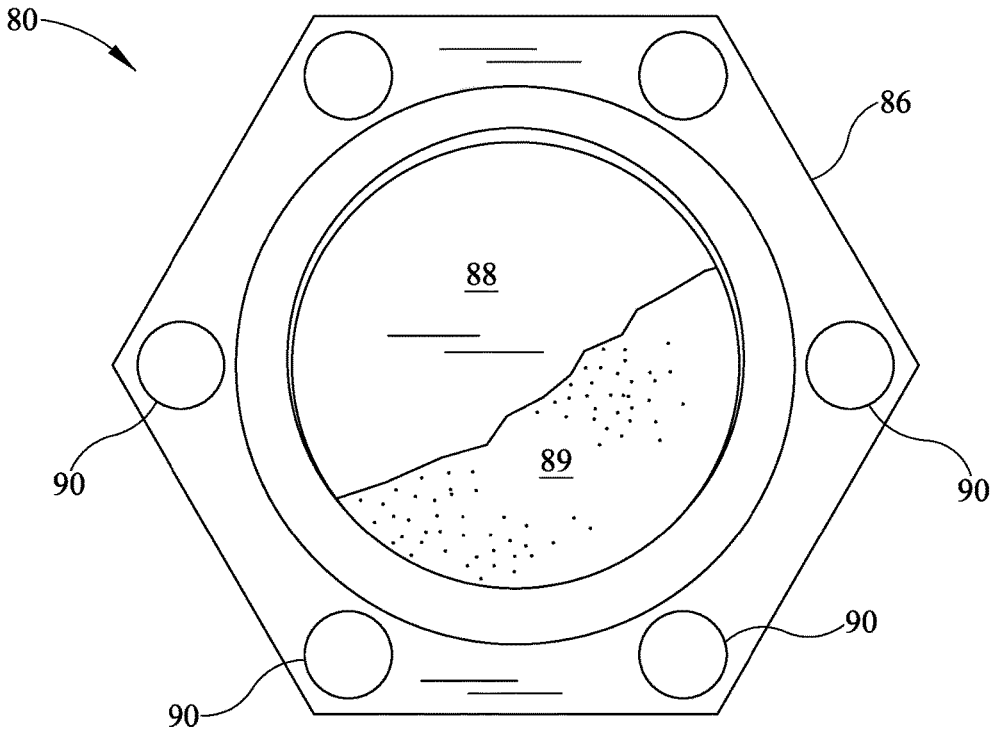
FIG. 16 is a bottom view of the cap of FIG. 14.

FIGS. 14-16 show an embodiment of the cap 80. Cap 80 has a cap first end 81 and a cap second end 82. Cap first end 81 comprises an outer cap cylinder 83 and an inner cap cylinder 84. Inner cap cylinder 84 further comprises female cap threads 85. Cap second end 82 comprises a hexagonal perimeter 86 and terminates in an upper cap surface 87 and a lower cap surface 88. In a preferred embodiment, lower cap surface 88 can be fitted with a gasket 89. Gasket 89 is preferably of material similar to that of gasket 51. Upper cap surface 87 can optionally have one or more openings 90 therethrough. Female cap threads 85 threadedly receive external bushing threads 67. The one or more openings 90 are similarly preferably used with one or more locks 37 to prevent or inhibit relative movement between the cap 80 and the bushing 60 and/or the main body 20.

A cap height 91 is a distance from the cap first end 81 to the lower cap surface 88 or, in embodiments using gasket 89 on the lower cap surface 88, then to gasket 89 (see FIG. 15). In the preferred embodiment, cap height 91 is approximately equal to or less than bushing length 69. In this way the bushing 60 can thread into the cap 80 and the external bushing threads 67 can be threaded all the way into the female cap threads 85 until the second end 62 seats itself or bears onto the lower cap surface 88 (or, where gasket material is used, onto the gasket 89).

Referring back to FIGS. 5-8, the backflush valve assembly 10 according to one embodiment is shown. The main body 20 receives therewithin the valve stem 41, wherein the valve stem threads 44 extend from the cavity 29 through the valve stem opening 28 and extend upwardly through the top surface 23 of the main body 20. This orientation orients the gasket 51 toward the bottom surface 24 of the main body 20. The bushing 60 is threaded onto the valve stem 20 with lower surface 64 oriented toward the top surface 23 of the main body 20. The internal bushing threads 68 of the bushing 60 are threaded onto the valve stem threads 44. The cap 80 is threaded onto the bushing 60 by threadedly mating the female cap threads 85 with the external bushing threads 67. In some embodiments, a thread sealant and/or adhesive may additionally be used between valve stem threads 44 and internal bushing threads 68. One example of a thread sealant is a thread locking adhesive suitable for metal threads, such as the thread locking adhesive sold under the trademark Loctite® 243™ by Henkel.

Figure 6:
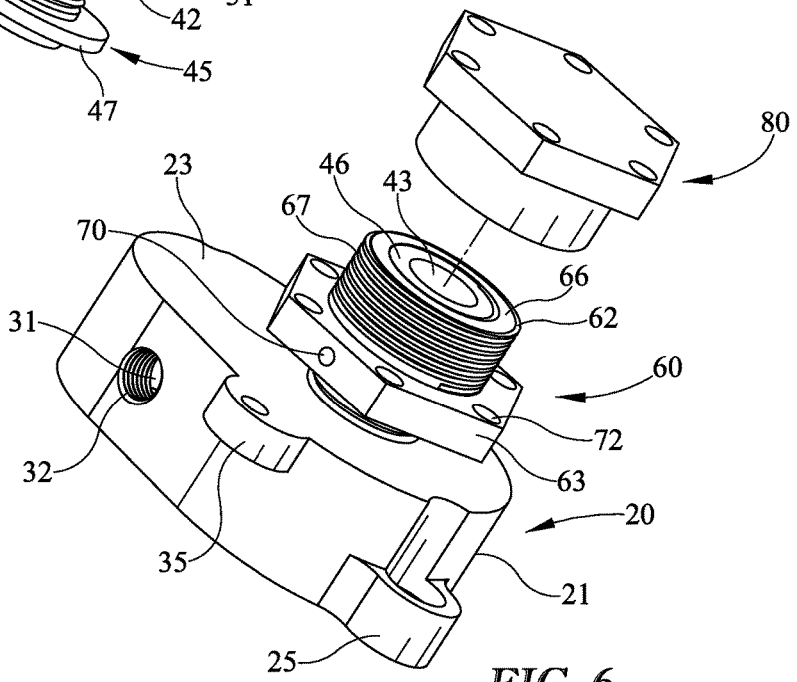
FIG. 6 is an exploded perspective view of the backflush valve assembly of FIG. 5 with valve stem threaded through the main body and the bushing threaded onto the valve stem.
Figure 7:
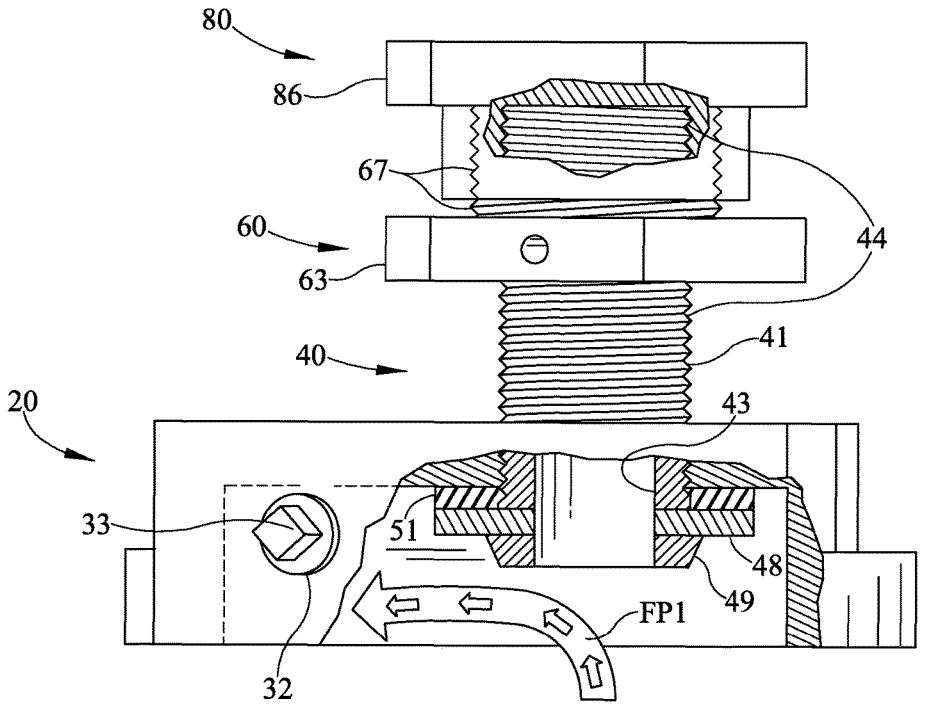
FIG. 7 is a partial cutaway sectional view of the backflush valve assembly of FIG. 3 showing the valve in a first (open) position allowing flow via first flow path.
Figure 8:
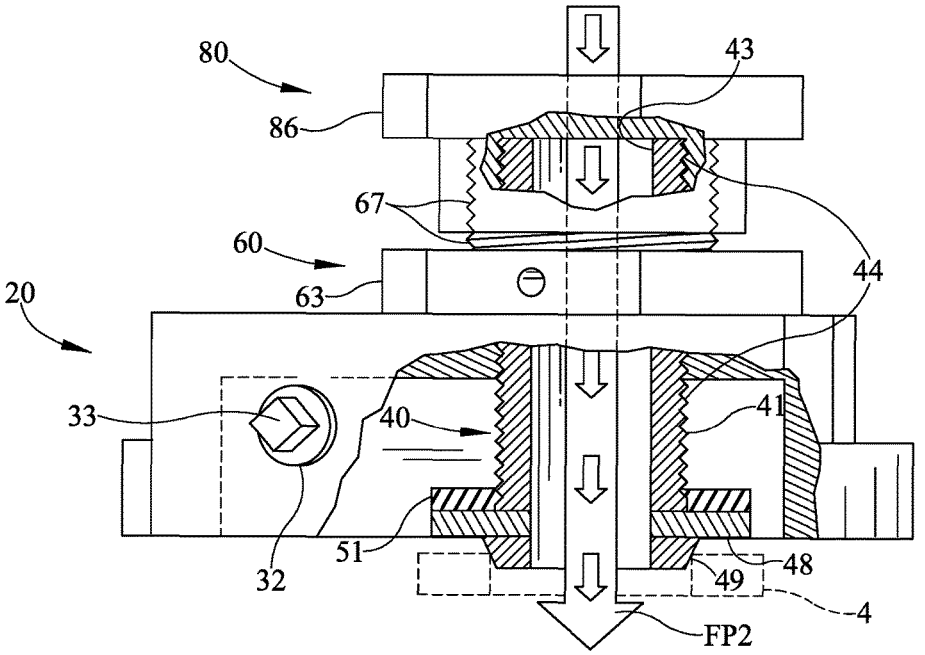
FIG. 8 is a partial cutaway sectional view of the backflush valve assembly of FIG. 3 showing the valve in a second (backflush) position allowing flow via a second flow path.

In some embodiments, as shown in FIGS. 11-13 and 17, one or more drive pins 71 can be inserted into the openings 72 to matingly couple the bushing 60 to the outer surface of the valve stem threads 44. Preferably, prior to installing the drive pins 71, the second end 62 of bushing 60 is brought flush with the second end 46 of valve stem 40, as shown in FIG. 6. In this way, the two planar surfaces of the second end 62 and second end 46 can advantageously simultaneously engage the gasket 89. This provides good leak prevention. The drive pins 71 are driven into the bushing 60 and valve stem 40 to mate them together. Installation of the drive pins 71 is typically done as a final assembly step. Although it is preferred to bring the second end 62 flush with the second end 46, it is possible also to join the bushing 60 to the valve stem 40 with the valve stem 40 extending slightly beyond the bushing 60 with no detrimental leaks likely to occur. It is possible to join the bushing 60 to the valve stem 40 with the bushing extending slightly beyond the valve stem 40, but this arrangement is likely to allow leaks to occur and is therefore not preferred.

Other methods and means of mating the bushing 60 to the valve stem 40 are also possible, including, for example, metal-to-metal cement, thread adhesives, spot welding, heat fusing, localized thread deformation, and the like. In the embodiments shown, drive pins are shown for ease of reference. In these embodiments, once the drive pins 71 are inserted, then rotation of the bushing 60 couplingly rotates valve stem 41. This allows the user to selectively move the valve stem 41 from a first position (fully open) to a second position (fully closed) by rotating the bushing 60, as described below.

In use, the backflush valve assembly 10 enables a user to selectively operate the valve 40 between two modes: a first mode (normal) wherein the valve is in a first position (see FIG. 7) and the engine oil cooler housing 1 operates normally, and a second mode (backflush) wherein the valve is in a second position (see FIG. 8) and the user can backflush the engine oil cooler housing 1 and portions of the coolant system through the internal surface 43 of the valve stem 41 of the backflush valve assembly 10. As discussed, the backflush valve assembly 10 according to one embodiment is a replacement for a stock EGR coolant supply cover 2 of an engine oil cooler housing 1 in a 6.0 Liter diesel engine sold under the trademark Powerstroke®. A user removes the stock EGR coolant supply cover 2 and replaces it with the backflush valve assembly 10 via mounting locations 25, as shown in FIGS. 2 and 4. To enable the engine oil cooler housing 1 to operate under normal operating conditions, the bushing 60 is rotated counterclockwise until the valve seat 47 of the valve stem 41 moves within the cavity 29 toward the bottom surface 24 whereupon eventually the gasket 51 will be brought into contact with the bottom surface 24 (see FIG. 7). Further counterclockwise rotation seals the valve stem 41 to the bottom surface 24 via the gasket 51. In this first position, coolant is allowed to flow in its normal pathway out of the EGR coolant supply port 4 through cavity 29 and out of the oil cooler outlet housing 3, i.e., via its normal flow path (first flow path FP1) in its normal direction through the engine oil cooler. In other words, first flow path FP1 involves the coolant exiting the engine oil cooler 1 via a port (not shown) in the oil cooler outlet housing 3 and not exiting the backflush valve assembly 10 at all.

With the backflush valve assembly 10, a user can also place the assembly into a second mode (FIG. 8), wherein the valve 40 occupies a second position (backflush) to allow water, air, or a combination thereof to be forced into the EGR coolant supply port 4 of the engine oil cooler 1 via a second flow path FP2 in a direction opposite the normal flow of coolant therewithin, thus backflushing the engine oil cooler 1. In the second flow path FP2, water or other liquid is forced to flow through the internal surface 43 of the valve stem 41 directly into the EGR coolant supply port 4. To backflush, a user rotates the bushing 60 clockwise to move the valve stem 41 into its second position. Rotating the bushing 60 causes rotation of the valve stem 41 in this embodiment because of the presence of the one or more drive pins 71 that effectively joins the bushing 60 to the valve stem 41. In this backflush position, the valve seat 47 moves into position over top the EGR coolant supply port 4. Further clockwise rotation forces a tight fit between an upper surface of the EGR coolant supply port 4 and the ramped surface 49, forming a tight engagement therebetween. The cap 80 is removed by unthreading the female cap threads 85 from the external bushing threads 67. With the cap 80 removed, the internal surface 43 of the valve stem 41 provides a second flow path FP2 for backflush liquid into the engine oil cooler 1 in a direction opposite the natural flow of coolant.

Figure 18:
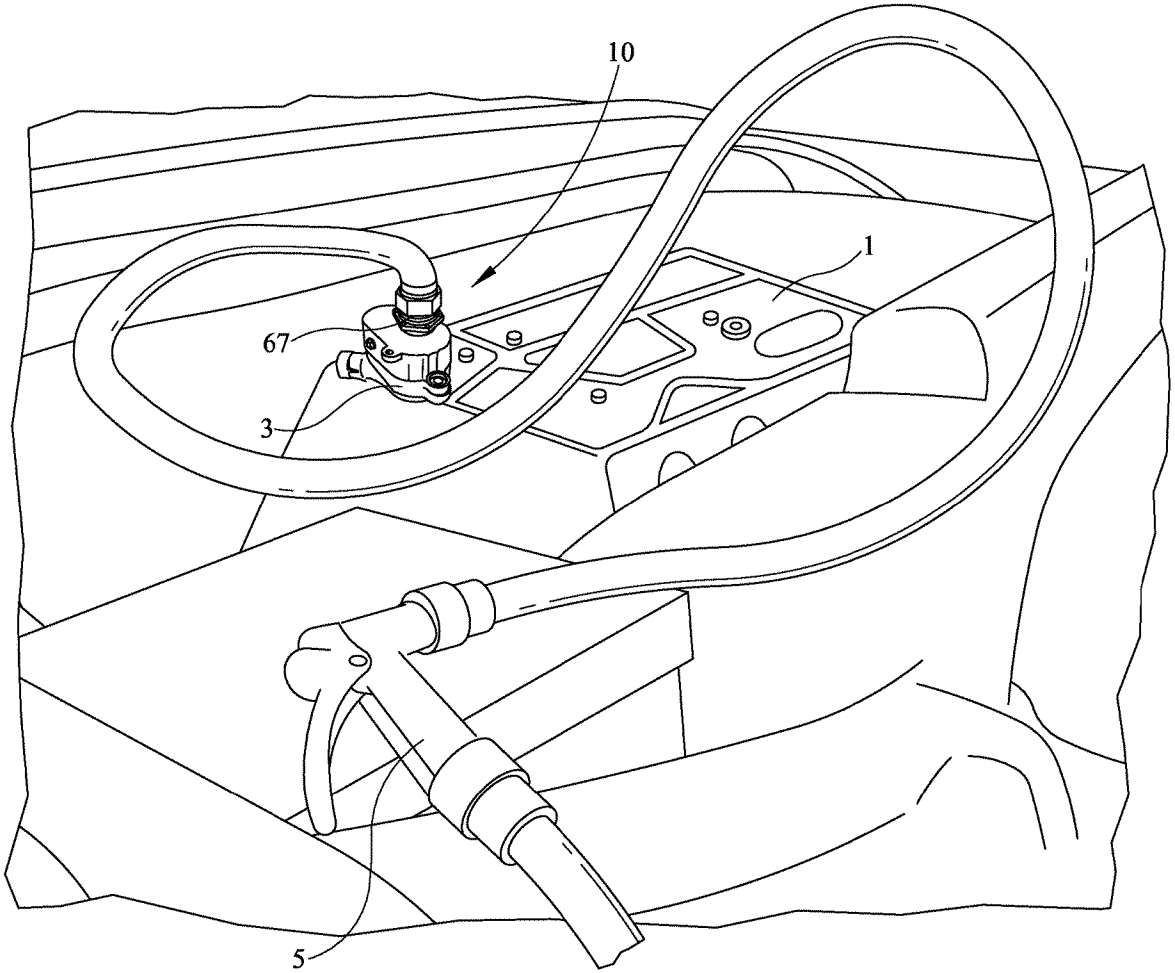
FIG. 18 is a perspective view of the backflush valve assembly according to an embodiment being connected to an engine oil cooler housing for use to backflush the engine oil cooler.
Figure 17:
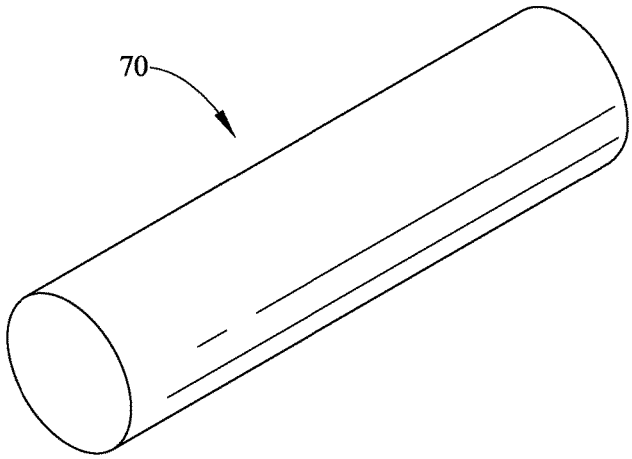
FIG. 17 is a perspective view of a drive pin according to an embodiment.

As shown in FIG. 18, a user simply attaches a water hose to the external bushing threads 67 and water will be forced to flow through the internal surface 43 of the valve stem 41 and into the engine oil cooler in a direction opposite to the normal direction of coolant flow. It should be noted that various fittings, including adapters, elbows, swivels, and the like can be used to assist in connecting a water source to the external busing threads 67 so that the user's water hose or nozzles connect conveniently as desired. Additionally, a short section of garden hose with a throttle (e.g., an in-line spray nozzle 5) can also be used to vary the water velocity during the backflush procedure.

In some embodiments, as shown in the figures, the cap height 91 and bushing length 69 are dimensioned such that the cap 80 can be rotated and, once the lower cap surface 88 (or, if used, the gasket 89) contacts the second end 62 of the bushing 60, further rotation of the cap 80 will automatically also rotate the bushing 60. In particular, the cap height 91 is not greater than, and preferably slightly less than, bushing length 69. Once the second end 62 of the bushing contacts the lower cap surface 88 (or gasket 89), and because the one or more drive pins 71 secure the bushing 60 to the valve stem 41, then further rotation of the cap 80 actually rotates both the bushing 60 and the valve stem 41.

As stated, backflushing the oil cooler is simplified with the backflush valve assembly 10. Once the valve 40 has been placed in the second position (FIG. 8), the user can remove the cap 80 by unthreading it from the external bushing threads 67 of the bushing 60. The user then connects the desired fittings and adapters to connect the oil cooler with a source of water under pressure (FIG. 18). The user also removes the lower radiator hose so that the radiator can drain and so that backflush water can drain out of the radiator and, preferably, into a containment pan. Once the pressurized water source is connected to the backflush valve assembly 10, the user turns on the water supply. Water then flows into the backflush valve assembly 10 via internal surface 43 of the valve stem 41 into the oil cooler outlet housing 3 and through the oil cooler in a direction opposite the natural flow of coolant during normal operating conditions. The backflush water is allowed to flow for several minutes (e.g., approximately five to fifteen typically provides good results), removing dirt and debris from the small passages within the engine oil cooler 1 and depositing them into the containment pan. In a preferred method, a nozzle 5 is attached to the backflush water source so that the user can periodically activate the nozzle to increase the backflush water velocity, thus further assisting in removing debris from the oil cooler. Also in a preferred embodiment, the user can quickly turn the vehicle's ignition a few times (without starting the vehicle) so that the water pump shaft moves into different positions, thus further assisting in removing debris that might be stuck in the water pump. The user can monitor the removal of debris by inspecting the containment pan.

The backflush valve assembly 10 can also allow a user to add cleaners or other liquid solutions during a backflush procedure to further clean or condition the oil cooler. Once the user is satisfied that the backflush has removed all or a sufficient amount of debris, the user can shut off the supply of pressurized water, remove the water hose and adapters, and re-install the lower radiator hose. In a preferred method, prior to re-installing the lower radiator hose and the cap 80, the user can pour or otherwise add a desired quantity of distilled water into the backflush valve assembly 10 and allow it to drain out. This ideally rinses out any chemicals that might have been included in the backflush water supply. Once satisfied with the backflush, the user re-installs the lower radiator hose and re-installs the cap 80 by threading it onto the external bushing threads 67. Once the cap 80 has been threaded all the way onto the bushing 60 until the second end 62 contacts the lower cap surface 88 (gasket 89), the bushing 60 is rotated counterclockwise and because the bushing 60 is coupled to the valve stem 41 via one or more drive pins 70 (and optionally thread sealant, if used), this also causes counterclockwise rotation of the valve stem 41. This rotation moves the valve stem 41 from its second position back to its first position, where the gasket 51 is tightly seated against the bottom surface 24 of the main body 20. Preferably a lock 37 is inserted through one or more of opening 36, openings 72, and openings 90 to help keep the bushing 60, cap 80, and valve 40 from rotating loose, which could cause a leak or loss of components. The backflush valve assembly 10 is now in normal operating mode, and coolant will flow through the oil cooler in its normal direction.

Additional uses of the backflush valve assembly 10 are helpful to a user as well. With reference again to FIGS. 5-9, diagnostic port 31 can be used to insert various instruments for diagnostics, for example a temperature gauge, pressure gauge, or other types of sensors. By unscrewing the plug 33 and inserting a pressure gauge into the internal threads 32, a user can monitor operating pressure and/or temperature. If the user does not wish to monitor conditions during normal operation, the user can insert plug 33 into plug threads 34.

It will be appreciated that through appropriate design of the main body 20, valve 40, bushing 60 (if used), and cap 80, the fluid flow paths, fluid temperature, and operating parameters may be controlled if desired. Further, in some embodiments, separate inlets may be used to supply compressed air or other gases or liquids to the backflush valve assembly 10. Additional components, or various alternative components of known type, can be substituted without detracting from the nature and spirit of the inventive apparatus. For example, other forms of valves could be used, and other forms of known fittings for coupling a fluid flow path through a surface could be used. Additionally, other means of providing sealing to reduce fluid contamination is possible.

Figure 19:
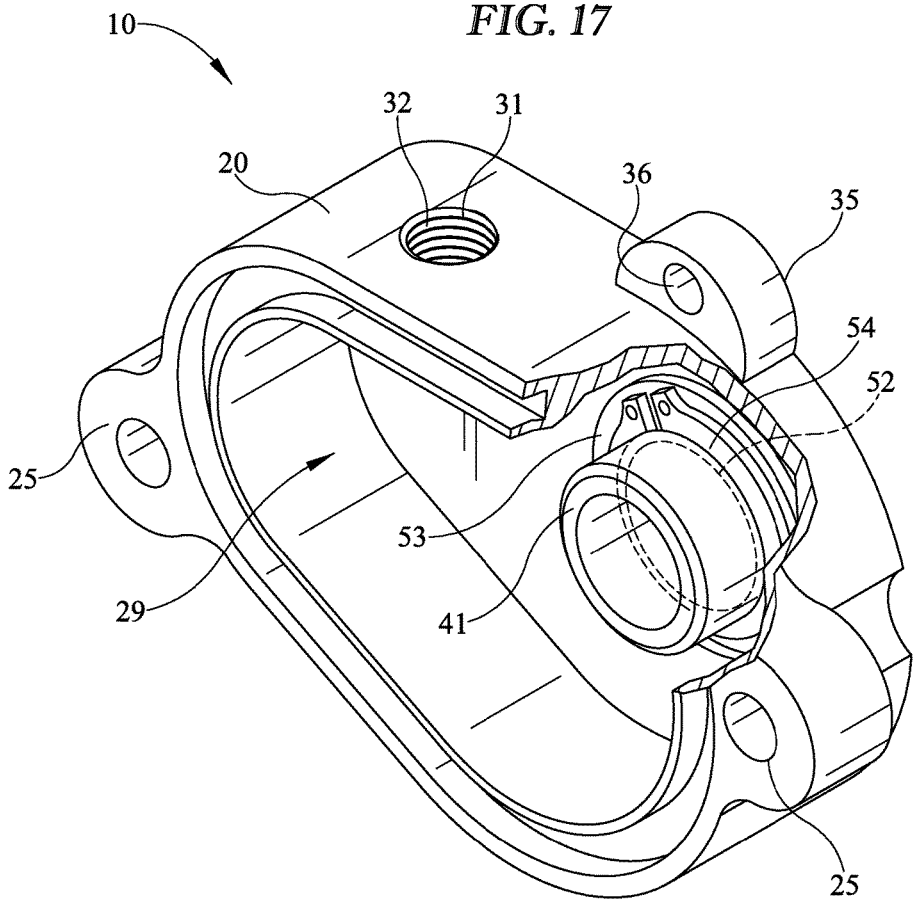
FIG. 19 is a perspective view of a backflush valve according to an alternative embodiment wherein the valve stem employs a compression washer and a snap ring to retain it within the main body.

In other embodiments, different valve stem designs can be used. For example, as shown in FIG. 19, the valve stem 41 can include a snap ring groove 52 in the first end 45. A compression washer 53 can be installed over the valve stem 41 within the cavity 29, and a snap ring 54 can be fitted into the snap ring groove 52 to retain the valve stem 41 in the main body 20.

In other embodiments as discussed above, the valve stem 41 can be coupled to bushing 60 in ways other than the drive pins 71. Additionally, the bushing 60 could be eliminated altogether as a separate component. In such an embodiment, for example, the valve stem 41 could be fashioned as a stem having two different threads, a set of valve stem threads 44 and a larger set of threads to mate with the female cap threads 85. Alternatively, the valve stem threads 44 could be the same size as the external bushing threads 67 such that the female cap threads 85 mate directly to the valve stem threads 44.

In the preferred embodiments described herein, the main body 20, valve stem 41, bushing 60, and cap 80 are manufactured from aluminum stock on computerized numeric controlled (CNC) milling machines. These components could be, however, made from other materials, such as various grades and types of steel, on other machines, such as standard milling machines. Other commonly known manufacturing methods and materials could obviously be used, including, without limitation, molding, casting, 3-D printing, and other forms of additive manufacturing.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used.

Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching. Various additional modifications may be made to the illustrated embodiments consistent with the invention. Therefore, the invention lies in the claims hereinafter appended.

What is claimed is:

1. A replacement EGR coolant supply cover for an engine oil cooler outlet housing having an EGR coolant supply port therein, the replacement EGR coolant supply cover comprising:

a main body having a top surface, a bottom surface, and a perimeter depending from said top surface and defining a downwardly facing cavity, said top surface having a fluid inlet therethrough positioned over and in line with said EGR coolant supply port and said perimeter having at least two mounting locations therearound for mounting said replacement EGR coolant supply cover to the oil cooler outlet housing;

a backflush valve in said fluid inlet, said valve including a valve stem having a first end and a second end, said first end having a valve seat thereon and said second end terminating in an open hollow cylinder;

a bushing connected to said valve stem, said bushing further comprising a first end and a second end, wherein said second end further comprises an open cylinder with external bushing threads for coupling with a water hose and internal bushing threads for coupling with said valve stem, and wherein said internal bushing threads extend throughout the entirety of said bushing; and a cap having an open cap first end with internal cap threads therein and a closed second end comprising a cap surface;

wherein said valve stem is movable from a first position to a second position, wherein in said first position said valve stem is not seated on said EGR coolant supply port, thereby allowing coolant to flow in a first direction from said EGR coolant supply port through the oil cooler outlet housing, and wherein in said second position said valve stem is seated on said EGR coolant supply port, thereby allowing water to be flushed through said open hollow cylinder of said valve in a second direction from said open hollow cylinder through said EGR coolant supply port.

2. The backflush valve assembly according to claim 1 wherein said fluid inlet is threaded.

3. The backflush valve assembly according to claim 2 wherein said valve is a rotatable valve.

4. The backflush valve assembly according to claim 3 wherein said valve stem further includes a gasket fitted around said valve stem between said valve seat and said second end.

5. The backflush valve assembly according to claim 4 wherein said gasket seals said fluid inlet when said valve stem is in said first position.

6. The backflush valve assembly according to claim 5 wherein said valve seat further includes a valve seat flange, a ramped annular surface, and a bottom annular surface.

7. The backflush valve assembly according to claim 6 wherein said ramped surface of said valve seat contacts a surface of said EGR coolant supply port to prevent backflush water from escaping the open hollow cylinder into said downwardly facing cavity of the main body.

8. The backflush valve assembly according to claim 1 wherein said cap further comprises a gasket therein.

9. The backflush valve assembly according to claim 1 wherein said first end of said bushing further includes a perimeter having at least two flat surfaces.

10. The backflush valve assembly according to claim 9 wherein said perimeter includes six flat surfaces arranged as a hexagon.

11. The backflush valve assembly according to claim 9 wherein said first end of said bushing further includes at least one opening therein for receiving a lock.

12. The backflush valve assembly according to claim 1 wherein said second end of said cap further includes a perimeter having at least two flat surfaces.

13. The backflush valve assembly according to claim 12 wherein said perimeter includes six flat surfaces arranged as a hexagon.

14. The backflush valve assembly according to claim 9 wherein said second end of said cap further includes at least one opening therein for receiving a lock.

15. A replacement EGR coolant supply cover for an engine oil cooler outlet housing having an EGR coolant supply port said replacement EGR coolant supply cover comprising:

a main body having at least one mounting location for mounting said housing to the engine oil cooler outlet housing, wherein said EGR coolant supply port directs coolant from an engine oil cooler to an engine oil cooler exit, said housing further comprising a cavity having a volume therein and defining a first flow path therein, wherein fluid can flow from the EGR coolant supply port through said first flow path to said engine oil cooler exit;

a backflush valve within said housing located over and in line with the EGR coolant supply port, wherein said valve is movable between an open position and a closed position, wherein in said open position said valve is not in contact with said EGR coolant supply port and in said closed position said valve is in contact with said EGR coolant supply port, and wherein said valve has a fluid channel therethrough that is not in fluid communication with said first flow path when said valve is in said closed position; and a removable cap coupled to said valve, wherein said removable cap closes off said first flow path when said valve is in said open position.

16. The backflush valve assembly according to claim 15 wherein said valve is a threaded valve.

17. The backflush valve assembly according to claim 16 wherein said valve further comprises a gasket that seats against said housing when said valve is in said open position.

18. The backflush valve assembly according to claim 15 further comprising a lock to secure said removable cap to said valve.

19. The backflush valve assembly according to claim 1 wherein said main body is permanently mounted to the engine oil cooler.

20. A replacement EGR coolant supply cover for an engine oil cooler outlet housing having an EGR coolant supply port and an oil cooler exit, said replacement EGR coolant supply cover comprising:

a main body having at least one mounting location for mounting said housing to the engine oil cooler housing, said housing further comprising a cavity having a volume therein and defining a first flow path therein, wherein fluid can flow from the EGR coolant supply port through said first flow path to said engine oil cooler exit;

a backflush valve within said housing having a fluid channel therethrough that is located in line with the EGR coolant supply port, and having valve external threads thereon for coupling with a water hose;

wherein said valve is movable between an open position and a backflush position, wherein in said open position said valve is not in contact with said EGR coolant supply port, and in said backflush position said valve is in contact with said EGR coolant supply port, and wherein when said valve is in said open position fluid can flow through said first flow path in a first direction from the EGR coolant supply port toward the oil cooler exit, and when said valve is in said backflush position fluid cannot flow through said first flow path in said first direction but can only flow through a second flow path from the water hose through said EGR coolant supply port; and a removable cap coupled to said valve external threads, wherein said removable cap prevents fluid from escaping said backflush valve when the fluid is flowing through said first flow path and said valve is in said open position.

21. The replacement EGR coolant supply cover of claim 20 wherein said backflush valve is a threaded valve.

22. The replacement EGR coolant supply cover of claim 20 wherein said cap further comprises a perimeter having at least two flat surfaces.

* * * * *